US007025627B2

(12) United States Patent
Rosenthal et al.

(10) Patent No.: US 7,025,627 B2
(45) Date of Patent: Apr. 11, 2006

(54) APPARATUS FOR CONNECTING AND ORGANIZING CORDS AND CABLES

(75) Inventors: Leslie David Rosenthal, Rockville, MD (US); Jason Scott Holland, Raleigh, NC (US)

(73) Assignee: Leap Technologies, Inc., Rockville, MD (US)

( * ) Notice: Subject to any disclaimer, the term of this patent is extended or adjusted under 35 U.S.C. 154(b) by 0 days.

(21) Appl. No.: 10/958,747

(22) Filed: Oct. 5, 2004

(65) Prior Publication Data

US 2005/0164545 A1 Jul. 28, 2005

Related U.S. Application Data

(60) Provisional application No. 60/539,390, filed on Jan. 27, 2004.

(51) Int. Cl.
*H01R 13/72* (2006.01)

(52) U.S. Cl. ..... 439/501; 439/650; 439/142

(58) Field of Classification Search ..... 439/501, 439/502, 650, 653, 639, 654, 142, 144; 62/314
See application file for complete search history.

(56) References Cited

U.S. PATENT DOCUMENTS

| | | | | |
|---|---|---|---|---|
| 4,944,694 | A * | 7/1990 | Dorn | 439/501 |
| 5,596,479 | A | 1/1997 | Campbell et al. | 361/643 |
| 5,857,350 | A * | 1/1999 | Johnson et al. | 62/314 |
| 5,899,761 | A * | 5/1999 | Crane et al. | 439/142 |
| 5,906,506 | A * | 5/1999 | Chang et al. | 439/500 |
| 5,906,517 | A * | 5/1999 | Crane et al. | 439/654 |
| 5,924,892 | A | 7/1999 | Ferracina | 439/501 |
| 5,947,765 | A | 9/1999 | Carlson, Jr. et al. | 439/535 |
| 6,017,228 | A | 1/2000 | Verbeek et al. | 439/142 |
| 6,109,958 | A * | 8/2000 | Ke | 439/535 |
| 6,135,810 | A * | 10/2000 | Damson et al. | 439/501 |
| D445,766 | S | 7/2001 | Solomon | D13/199 |
| 6,331,121 | B1 | 12/2001 | Raeford, Sr. | 439/501 |
| 6,349,452 | B1 * | 2/2002 | Cisneros | 24/306 |
| D465,201 | S | 11/2002 | Gershfeld | D13/139.4 |
| 6,780,047 | B1 * | 8/2004 | Laity et al. | 439/501 |
| 2002/0127906 | A1 * | 9/2002 | Soon | 439/501 |
| 2004/0104037 | A1 | 6/2004 | Solet | 174/50 |

* cited by examiner

*Primary Examiner*—Hien Vu
(74) *Attorney, Agent, or Firm*—Stephen S. Mosher

(57) ABSTRACT

There is disclosed an apparatus for concealing, connecting and organizing power cords and signal cables from multiple devices in an equipment installation comprising a compact enclosure for use on a desktop that has first and second interior side panels facing each other without obstruction across the floor of the enclosure, and a hinged, reinforced, load-bearing top lid. A plurality of AC power outlets is disposed on either or both of the first and second interior side panels and connected in a power circuit via an ON/OFF switch to a power supply cord. The power circuit includes circuits for suppressing interference and transients. The enclosure includes space for containing and plugging in compact power supply blocks and storage space between the first and second interior panels for connecting, organizing and storing excess lengths of the cords and cables.

20 Claims, 7 Drawing Sheets

APPARATUS FOR CONNECTING AND ORGANIZING CORDS AND CABLES

CROSS REFERENCE TO RELATED APPLICATIONS

The present application claims priority to a U.S. Provisional Patent Application Ser. No. 60/539,390 filed Jan. 27, 2004 and entitled "Device to Secure And Protect Communications Cables And Power Cords;" and is related to U.S. Design patent application Ser. No. 29/211,543 filed Aug. 18, 2004 and entitled "Enclosure For Desktop Power Cord And Cable Management."

FIELD OF THE INVENTION

The present invention generally relates to apparatus and methods for managing cords, cables and accessories in equipment installations and, more particularly, to compact, desktop-sized apparatus for connecting, organizing and storing cords, cables and accessories in multiple unit equipment installations.

BACKGROUND AND DESCRIPTION OF THE PRIOR ART

The management of cords, cables and accessory devices in multiple unit installations of audio, video, computing, security or maintenance equipment is an ongoing problem because of the variety of devices that may be connected together in a system, where each device typically includes a separate power cord and may require one or more signal cables or other connecting cables or interfaces in the system. If the system includes more than two or three items of equipment, the organizing, concealing and storage of the cords and cables becomes more difficult, often resulting in haphazard, confusing, unsightly and even unsafe "rat's nests" of wiring and accessory devices. Even though conventional outlet strips can be used to provide an electrical outlet or receptacle for each power cord in the system, this solution does not otherwise address the problem of organizing, concealing or managing an assortment of many cords. Further, many devices require the use of numerous signal cables for conveying signals into and out of the device. Such cables, if organized at all, are most often bundled together with a cable tie, a piece of tape or a cord; yet this typical solution often does not adequately address the problem of organizing, concealing or otherwise managing an assortment of numerous cables.

A number of solutions for managing cords and cables exist in the prior art, among them U.S. Pat. No. 5,596,479 issued to Campbell, et al. for a "Power Surge Protector," directed to a housing having a sliding cover and containing a plurality of electrical receptacles connected to a power line with surge protection, individual power switches, and storage space for excess lengths of cords. The housing can support up to 70 pounds on its top and includes internal structures for organizing the cords stored within it. However, the internal structures to support such loads also provide some obstruction to the placement or arrangement of cords within the housing, thereby limiting the use of the interior space for storage. Further, it is a very low profile design that precludes the storage therein of power supply blocks such as typically used to supply power for printers, modems and other peripherals or accessories. Moreover, while the housing can support up to 70 pounds on its top, it achieves this strength by the same internal structures used to organize the cords. Without such internal structures within the storage space of this housing, the load-bearing capacity of the housing is diminished.

Another, similar solution is disclosed in U.S. Pat. No. 5,924,892 issued to Ferracina for a "Device For Electrically Powering A Plurality of User Items Provided With Their Own Electrical Feed And Data Transfer Cables, To At Least Partially Contain These Cables During Said Feed." This patent is directed to a two-piece box, the two pieces hinged together on one side, containing a plurality of internal AC receptacles, spaces for some excess cord length of a number of power cords, and a vertical post allocated to each of the cord spaces for wrapping the cords there around. The posts include covering means for securing the cords wrapped around the posts. However, the solution disclosed in this patent suffers from the same deficiencies as the one preceding in that the posts and covering means for securing the cords that occupy some of the storage space obstructs the storage space, limiting the use that may be made of it for storing cords or cables or other items. In addition, this unit lacks any power line filtering or transient suppression.

In another patent, U.S. Pat. No. 6,017,228 issued to Verbeek, et al. and directed to an "Electrical Station," a floor-standing storage cabinet having an internal outlet panel, communication receptacles and top and front access panels, also includes room for the storage of cords and cables. The unit is designed to be connected to electrical conduits and floor-mounted outlet boxes. However, this unit, while it has ample storage space for cords and cables, is not suitable for desktop or component shelf use because of its bulk.

Yet another solution is disclosed in U.S. Pat. No. D445,766 issued to Soloman, which is directed to the ornamental design of a "Housing For Mounting, Arranging, And Securing Electrical Power Lines To A Computer." Shown is a rectangular wire basket formed of an open mesh and having a hinged lid panel formed of a sheet material, an AC outlet strip and power cord attached to in inside portion of the wire basket, and several brackets attached to the inside of the wire basket for wrapping and securing power cords there around. However, this basket is not capable of concealing the cords stored within it. Further, it appears to be unsuited to use on a desktop or component shelf.

What is needed is a compact cord and cable storage unit—a cable management device—suitable for desktop or component shelf use, that maximizes the utility of its internal storage space by eliminating obstructions from the space to be occupied by the cords and cables stored therein, and yet has the structural strength for supporting the weight of, for example, a CRT (cathode ray tube) video monitor. Such a unit would efficiently provide for concealing, connecting, organizing and storing the cords and cables of the component system in which it is installed. Such a unit would also provide for protection from power line interference and transients.

SUMMARY OF THE INVENTION

Accordingly there is disclosed herein an apparatus for concealing, connecting and organizing power cords and signal cables from multiple devices in an equipment installation. The apparatus includes a compact enclosure for use on a desktop that has first and second interior side panels facing each other without obstruction therebetween across a floor of the enclosure, at least one front or rear access opening, and a hinged, reinforced, load-bearing top lid. A plurality of AC power outlets is disposed on either or both of the first and second interior side panels and connected in a power circuit via an ON/OFF switch to a power supply cord. Electrical circuitry is coupled with the power circuit for suppressing interference and transients, and providing protection against excessive current being drawn from the unit. The enclosure of the apparatus includes space for containing and plugging in compact power supply blocks and storage space between the first and second interior panels for connecting, organizing and storing excess lengths of the cords and cables.

DETAILED DESCRIPTION OF THE INVENTION

Figure 1:
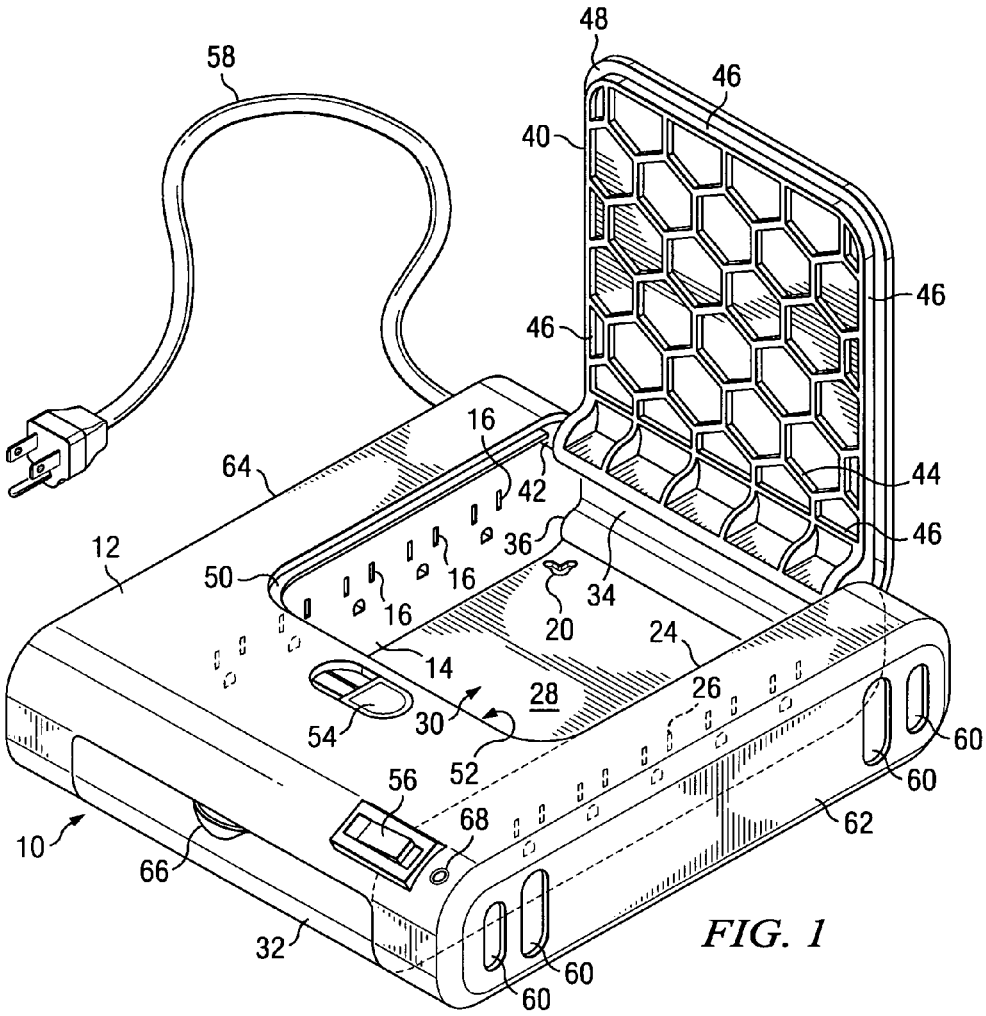
FIG. 1 illustrates a perspective view of one embodiment of a device for connecting and storing cords and cables according to the present disclosure.

FIG. 1 illustrates a perspective view of one embodiment of a device for connecting and storing or concealing cords and cables according to the present disclosure. The device, for purposes of the present description, will be called a connection system 10. The connection system 10 may be used for connecting and storing or concealing the power cords and/or low voltage power supply "blocks" from multiple components in an equipment installation. The equipment installation may include components of an audio system, a video system, a computing system, a security system, a maintenance system and the like. The connection system 10 may also be used, for example, as a data network hub containing expansion or connectivity modules and their associated signal and power cables or cords. The illustrative embodiment of the connection system 10 described herein is approximately 12"×12"×2-¾" and is compact enough to be placed on a component shelf or desktop. It may also be mounted on a wall of a room or a cabinet using mounting holes provided in the floor of the enclosure, depending upon the particular equipment installation. The connection system 10 in the exemplary embodiment may contain up to approximately ten AC receptacles for connecting the power cords of equipment in the system in which it is used. Further, space may be provided in the present or in other embodiments for one or more expansion modules that may be used in enhancing the connectivity of the equipment installation. One of the principle features of the connection system 10 disclosed herein is the substantial unobstructed interior space provided for storing the excess length of cords and cables connected therein. Other features include but are not limited to hinged access doors in the rear and/or front panels of the housing of the connection system 10, provision for a built-in RF interference filter and transient suppression circuit, a reinforced, load-bearing top lid and the ability to support substantial weight stacked on top of the connection system 10, non-obstructive provision for securing cords and cables, and a master ON/OFF switch and pilot indicator.

Referring to FIG. 1, the connection system 10 includes a housing or enclosure 12. The components of the enclosure 12 may be preferably fabricated from a thermoplastic material such as an ABS plastic in an injection molding process. However, other materials and fabrication methods are certainly feasible as will be appreciated by persons skilled in the art. Visible inside the enclosure 12 is a first interior side panel 14 upon which are mounted a plurality of AC receptacles 16. Although five receptacles 16 are shown on side panel 14 in FIG. 1, only three are labeled with the reference number 16 for clarity in the figure. Also included inside the enclosure 12, and directly opposite the first interior side panel 14, is a second interior side panel 24 (not visible in FIG. 1) upon which are mounted a plurality of AC receptacles 26, one of which is identified with a reference number. In the illustrative embodiment of FIG. 1, each side panel 14, 24 may include up to five AC receptacles 16, 26. Further, the first and second interior side panels 14, 24 generally face each other across a floor 28 of the enclosure 12, and in the illustrative embodiment may be substantially parallel to each other. The floor 28 of the enclosure 12 may include several holes, e.g., at three or four corners of the floor 28, such as the mounting hole 20, for mounting the enclosure 12 on a wall or other vertical surface. The floor 28 of the enclosure may further include, on its underside and thus not visible in FIG. 1, non-skid mounting feet to support the connection system 10 just off the desktop or shelf on which it is located.

It will be appreciated that, unlike many of the prior art devices for connecting power cords, the space 30 between the first and second interior side panels 14, 24 of the present invention, and substantially between interior front and rear portions of the enclosure 12, is unobstructed by other structures. This unobstructed space thus provides the maximum space and flexibility for storing excess lengths of cords and cables within the enclosure 12 during use. Moreover, several examples of non-obstructive securing means for bundling and restraining cords and cables within the enclosure 12 may be used. For example, the floor 28 of the enclosure may include smooth surfaces to facilitate the attachment of cable clamps having self-adhesive bases. Further, the floor 28 may include holes for tying down and securing cable tying strips. As will further become apparent herein below, the top lid 40 of the enclosure 12 is a rigid, hinged, reinforced panel that may be securely latched to the enclosure 12 to contain a plurality of cords and cables coiled and bundled or otherwise secured within the enclosure 12. The foregoing examples are intended to be illustrative and not limiting.

The first and second interior side panels 14, 24 serve several other structural functions in the illustrative embodiment in addition to providing a convenient and solid mounting surface for the AC receptacles 16, 26. The side panels 14, 24 form an enclosed space behind them for isolating live wiring components of the power circuits connected to the AC receptacles as will be further described in conjunction with FIG. 2 herein. Further, the side panels 14, 24 may serve as structural bulkheads that provide substantial vertical support for the top surface of the enclosure 12, including the top lid 40, when it is in a closed position supported by a ledge 50 formed around the side and front borders of a lid opening 52 in the enclosure 12. In the preferred embodiment the side panels 14, 24 may be proximate and slightly recessed with respect to the top lid opening 52 to provide adequate support for the top lid 40 when it supports the weight of another device stacked on top of the enclosure 12, yet also maximize the unobstructed space between the side panels 14, 24. In other embodiments having fewer AC receptacles 16, 26, one or both of the side panels 14, 24 may be shorter, not extending fully across the length of the enclosure 12, to provide room for expansion modules, as will be described infra.

Continuing with FIG. 1, the enclosure 12 may include a front access door 32 that pivots along an axis approximately coincident with a lower edge of the access door 32. Similarly, the enclosure 12 may include a rear access door 34 that pivots along an axis of a hinge 36 approximately coincident with a lower edge of the access door 34. Cords and cables to be routed into and connected to receptacles within the enclosure 12 may be passed through either or both of the access doors 32, 34. The access doors 32, 34 may be configured to pivot outward from the upper edge of the respective access door opening and away from the enclosure 12. The access doors 32, 34 may also be configured with a latching mechanism (not shown) to secure the door to the enclosure 12 when the access doors 32, 34 are in a closed position.

Further, the enclosure 12 includes a top lid 40 that pivots about a hinged rear edge of the top lid 40 at a hinge 42 aligned along the rear edge of the top lid 40 adjacent an upper portion of a rear panel of the enclosure 12. The top lid 40 is reinforced by an integral honeycomb structure disposed on the underside surface of the top lid 40. The honeycomb structure 44 extends across both longitudinal and lateral dimensions of the top lid 40, terminating at a perimeter rail 46 formed into the underside of the top lid 40. Between the perimeter rail 46 and an outer edge of the top lid 40 is a land 48 disposed along first and second sides and a front side of the top lid 40. When the top lid is in a closed position, the land 48 rests on a ledge 50 disposed along respective sides of a top lid opening 52 in an upper surface of the enclosure 12. The honeycomb structure 44 is provided to impart substantial stiffness and load-bearing capability to the top lid 40 when the top lid 40 is in a closed position, particularly when a heavy component, such as a CRT monitor, is stacked on top of the connection system. The top lid 40 may be secured to the enclosure 12 by a latch 54. The latch 54 may be configured to hold the top lid 40 in a closed position despite pressure exerted from below the top lid 40 by cords and cables packed within the space 30 of the enclosure 12.

An ON/OFF switch 56 may be mounted on the enclosure 12, preferably on a forward surface of the enclosure 12. However, the ON/OFF switch 56 may be mounted in other locations on the enclosure 12 to suit a particular application. The ON/OFF switch may include a pilot indicator that illuminates the switch handle when power is ON, for example. A power cord 58, connected internally to power circuits to be described (see FIG. 2), is shown exiting the enclosure 12 from a rearward surface thereof and terminated in a standard AC plug. In a preferred embodiment, one end of the power cord 58 passes through one of the interior side panels 14, 24 to connect to the power circuits to be described. The power cord 58, terminated in a standard AC plug, then exits through an open rear door 34 to be routed to an AC receptacle (not shown) located near the equipment installation. Passing the power cord through the rear door 34 ensures that the rear door will be open during use to provide adequate circulation of air and the removal of any heat from current-carrying wiring within the enclosure 12 of the connection system 10. False vents 60, disposed in exterior side panels 62, 64, are a styling feature, ventilation being provided by the open rear door 34, as described herein above. A "surge status" indicator 68 may be provided on the front portion of the enclosure 12 to indicate when the capability of surge and transient circuitry within the connection system 10 have been compromised as will be described herein below.

Figure 2:
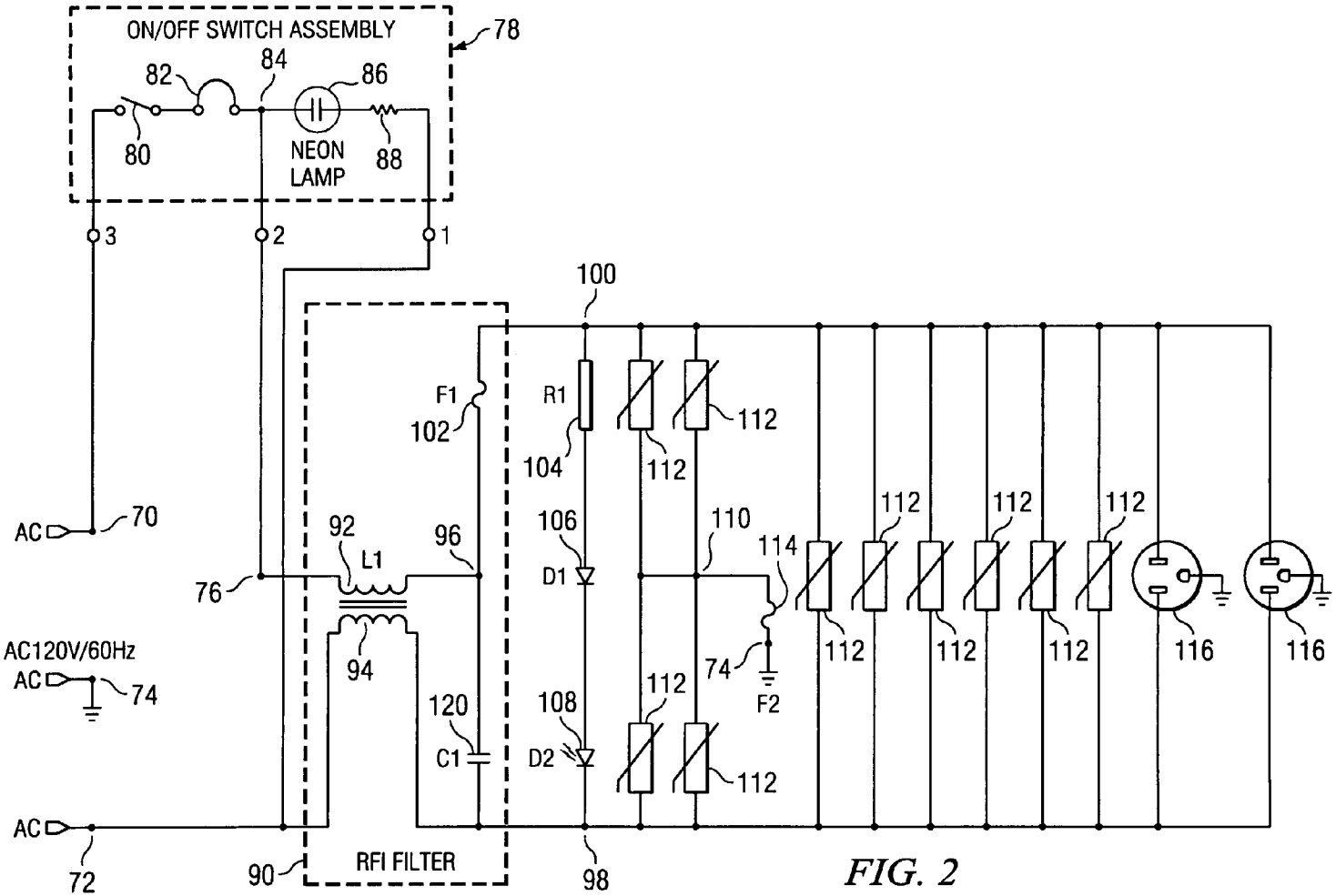
FIG. 2 illustrates a schematic diagram of the electrical circuitry portion of the embodiment of FIG. 1.

Referring to FIG. 2, there is illustrated a schematic diagram of the power circuits and the electrical circuitry portion of the illustrative embodiment of FIG. 1. In the power circuits, the line, neutral and ground conductors of the power cord 58 (of FIG. 1) connect respectively to nodes 70, 72 and 74 to supply 120 VAC/60 Hz to the connection system 10. An ON/OFF switch assembly 78 having three terminals (1, 2 and 3) is connected to the power line nodes 70 (terminal 3), 72 (terminal 1) and an output node 76 (terminal 2). Connected within the ON/OFF switch assembly in series between the terminal nos. 3 and 1 are, respectively, an SPST switch 80, a self-resetting circuit breaker 82, a node 84, a neon lamp 86 and a resistor 88. The self-resetting circuit breaker may be rated at, in this example, 15 Amps, 125 VAC. The node 84 is connected to terminal 2, which in turn is connected to the output node 76. The neon lamp 86 may be disposed within the body of the ON/OFF switch 80 and visible through a red colored translucent switch handle to indicate a power ON condition (not shown in this view; but, see the illustration of the ON/OFF switch 56 in FIG. 1).

Connected between the nodes 76 and 72 (the line and neutral sides of the AC power line), and a node 100 (a line output terminal) and a node 98 (a neutral output terminal), is a four terminal RFI filter 90 forming a portion of the electrical circuitry of the connection system 10. RFI filter 90 provides a filter for suppressing radio frequency interference (RFI) that may be present on the AC power line. The components of the illustrated RFI filter 90 may include an inductor L1 having a first winding 92 and a second winding 94 wound on a common core. The first winding 92 is connected between node 76 and an output node 96, in series with a fuse 102 that conducts AC line current to the balance of the electrical circuitry via the line output terminal 100. The second winding 94 is connected between the nodes 72 and 98 to complete a return path from the balance of the circuitry shown in FIG. 2 to the return (neutral) terminal at the node 72. Inductor L1 is configured to absorb common mode RF signals that may be present on the AC power line. A capacitor 120 is connected across the output of the RFI filter 90 (between the nodes 100 and 98) to suppress differential mode RF interference. The fuse 102, rated at 10 Amps in this example, may be selected for specific characteristics to expand the range of protected over-current conditions beyond the nominal protection provided by the self-resetting circuit breaker 82 in the ON/OFF switch assembly 78.

Continuing with FIG. 2, the power circuits include a plurality of AC receptacles 116 connected across the output terminals of the RFI filter 90 at the nodes 100, 98. While FIG. 2 shows only two AC receptacles 116 to save space on the drawing, in the illustrated embodiment up to ten AC receptacles may be used. However, in some embodiments, fewer AC receptacles may be used so that the some of the space of the enclosure 12 of the connection system 10 may be used for storing expansion modules (to be described) therein, as will be described herein below. Also connected across the nodes 100, 98 are additional portions of the electrical circuitry—a plurality of zinc oxide varistors 112. Some of the varistors 112 may be connected as a string of two varistors in series, with the common node 110 between them connected to the ground node 74 to suppress common mode power line transients. A fuse 114, rated at 5 Amps in this example, may be connected between the common node 110 and the ground node 74. Other of the varistors 112 may be connected across the power line (nodes 100, 98) to suppress differential mode power line transients. In the illustrative embodiment of the connection system 10, four varistors are connected in a common mode configuration and six varistors are connected in a differential mode configuration. The actual number of varistors used in the electrical circuitry and the numbers used in each of the two configurations may vary depending on the particular application and the ratings of the varistors selected.

The electrical circuitry shown in FIG. 2 further shows a surge status indicator circuit connected between the nodes 100 and 98. The circuit includes the series combination of a resistor 104, a rectifier diode 106, and a light emitting diode (LED) 108. During operation, the LED remains illuminated to indicate that the surge and transient suppression circuits are operational. If the LED ceases illumination, the suppression circuit has been compromised, such as by a component failure or an extraordinary power line fault event, for example. An example of such a failure is when one or more of the varistors has absorbed transient energy in excess of its ability to sustain the excess energy. One reason a plurality of such varistors is often used is that all of the varistors share in absorbing a part of the transient event, thus making it much more likely that each varistor will survive to remain functional for the next occurrence. In the illustrative embodiment of FIG. 2, the LED 108 is the same component as the surge status indicator 68 shown in FIG. 1.

Figure 3:
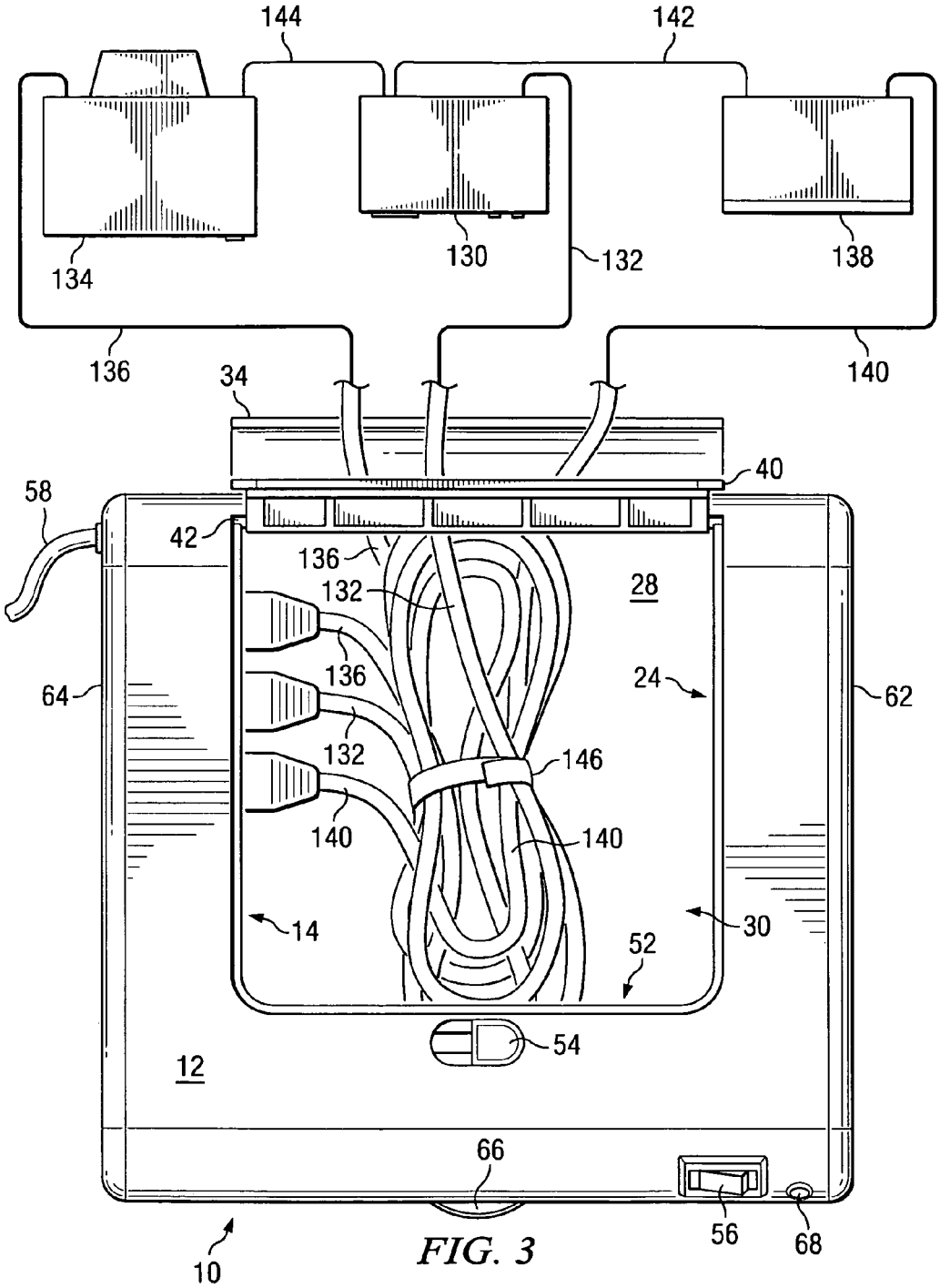
FIG. 3 illustrates a pictorial view of the embodiment of FIG. 1 as used in a typical application.

Referring to FIG. 3 there is illustrated a pictorial or plan view of the embodiment of FIG. 1 as used in one typical application. The connection system 10 having the enclosure 12 is shown connected for supplying power connections to several components of a video system having a receiver 130, a TV or monitor 134 and another program source such as a video disc player 138. The enclosure 12 includes first and second interior side panels 14, 24, a floor 28, a rear access door 34, and a top lid 40 supported on a hinge 42 and shown in a fully open position. Also shown are the top lid opening 52 of the enclosure 12, the latch 54 for the top lid 40, the ON/OFF switch 56, the power cord 58, the identification of the external sides 62, 64 of the enclosure 12, and the surge status indicator 68. The respective power cords 132, 136 and 140 of the components 130, 134 and 138 of the video system are shown plugged into the AC receptacles (see FIG. 1) mounted on the first interior side panel 14. The power cords 132, 136 and 140 pass through the rear access door 34 and the excess lengths thereof are coiled or bundled within the enclosure 12. The bundles are shown secured with a cable tying fastener 146, which may or may not be secured to the floor of the enclosure 12. Further, the video system may include individual signal cables connected between the components. For example, the receiver 130 may include a cable 142 to conduct signals from a program source to the receiver 130 and a cable 144 to conduct signals from the receiver 130 to the TV monitor 134.

In the illustrated example the excess lengths of signal cables may alternatively be routed to the connection system 10 of the present invention and stored or concealed within the enclosure 12 of the connection system 10. Further, equipment installations having more numerous components than illustrated in FIG. 3, may utilize the storage space available in the enclosure 12 for storing or concealing excess cable lengths. Moreover, in equipment installations that include several small components, i.e., expansion or functional accessory modules, the components themselves may be stored within the enclosure 12, as will be described herein below in conjunction with FIGS. 5 and 9.

Figure 4:
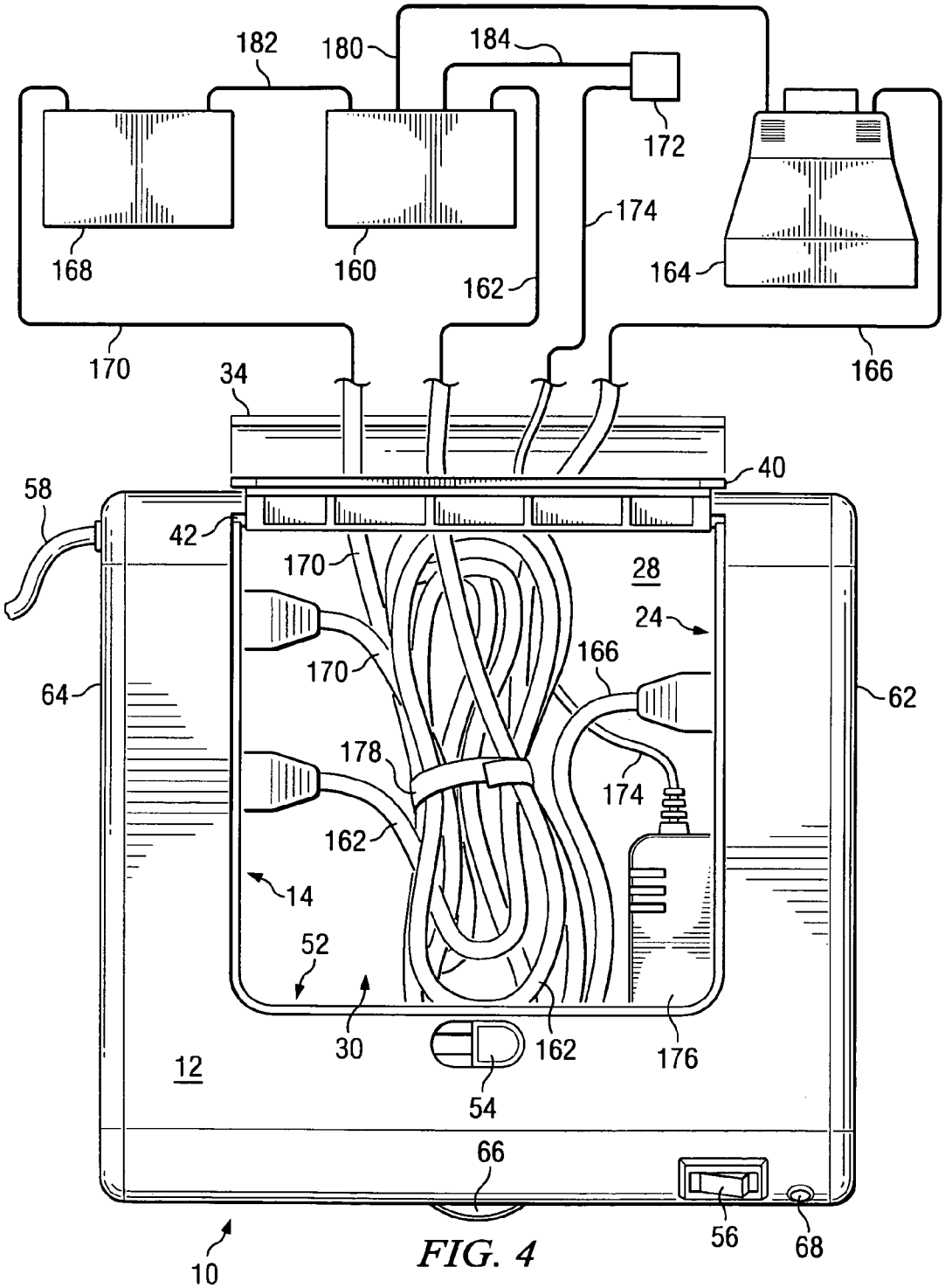
FIG. 4 illustrates a pictorial view of the embodiment of FIG. 1 as used in another typical application.

FIG. 4 illustrates a pictorial or plan view of the embodiment of FIG. 1 as used in another typical application. The connection system 10 having the enclosure 12 is shown connected to supply power connections to several components of a computer system having a computer 160, a monitor 164 and another peripheral such as a printer 168. The enclosure 12 includes first and second interior side panels 14, 24, a floor 28, a rear access door 34, and a top lid 40 supported on a hinge 42 and shown in a fully open position. Also shown are the top lid opening 52 of the enclosure 12, the latch 54 for the top lid 40, the ON/OFF switch 56, the power cord 58, the identification of the external sides 62, 64 of the enclosure 12, and the surge status indicator 68. The respective power cords 162, 166 and 170 of the components 160, 164 and 168 of the computer system are shown plugged into the AC receptacles (see FIG. 1) mounted on the first interior side panel 14. The power cords 162, 166 and 170 pass through the rear access door 34 and the excess lengths thereof are coiled or bundled within the enclosure 12. The bundles are shown secured with a cable tying fastener 178, which may or may not be secured to the floor of the enclosure 12, as described herein above in conjunction with the description for FIG. 1. Further, the computer system may include a modem 172 having a power cord 174 from a low voltage power supply block 176 that is plugged into an AC receptacle located on the second interior side panel 24 of the enclosure 12. Moreover, the computer system may include individual signal cables connected between the components. For example, the computer 160 may include a cable 180 to conduct signals from the computer 160 to the monitor 164, a cable 182 to conduct signals from the computer 160 to the printer 182, and a cable 184 between the computer 160 and the modem 172.

In the illustrated example the excess lengths of signal cables may alternatively be routed to the connection system 10 of the present invention and stored or concealed within the enclosure 12 of the connection system 10. Further, equipment installations having more numerous components than illustrated in FIG. 4, may utilize the storage space available in the enclosure 12 for storing or concealing excess cable lengths. Moreover, in equipment installations that include several small components, i.e., expansion or functional accessory modules, the components themselves may be stored within the enclosure 12, as will be described herein below in conjunction with FIGS. 5 through 9. Thus, the enclosure 12 is further adapted for receiving, docking or containing one or more functional accessory modules therewithin that are associated with the multiple devices of the equipment installation.

Figure 5:
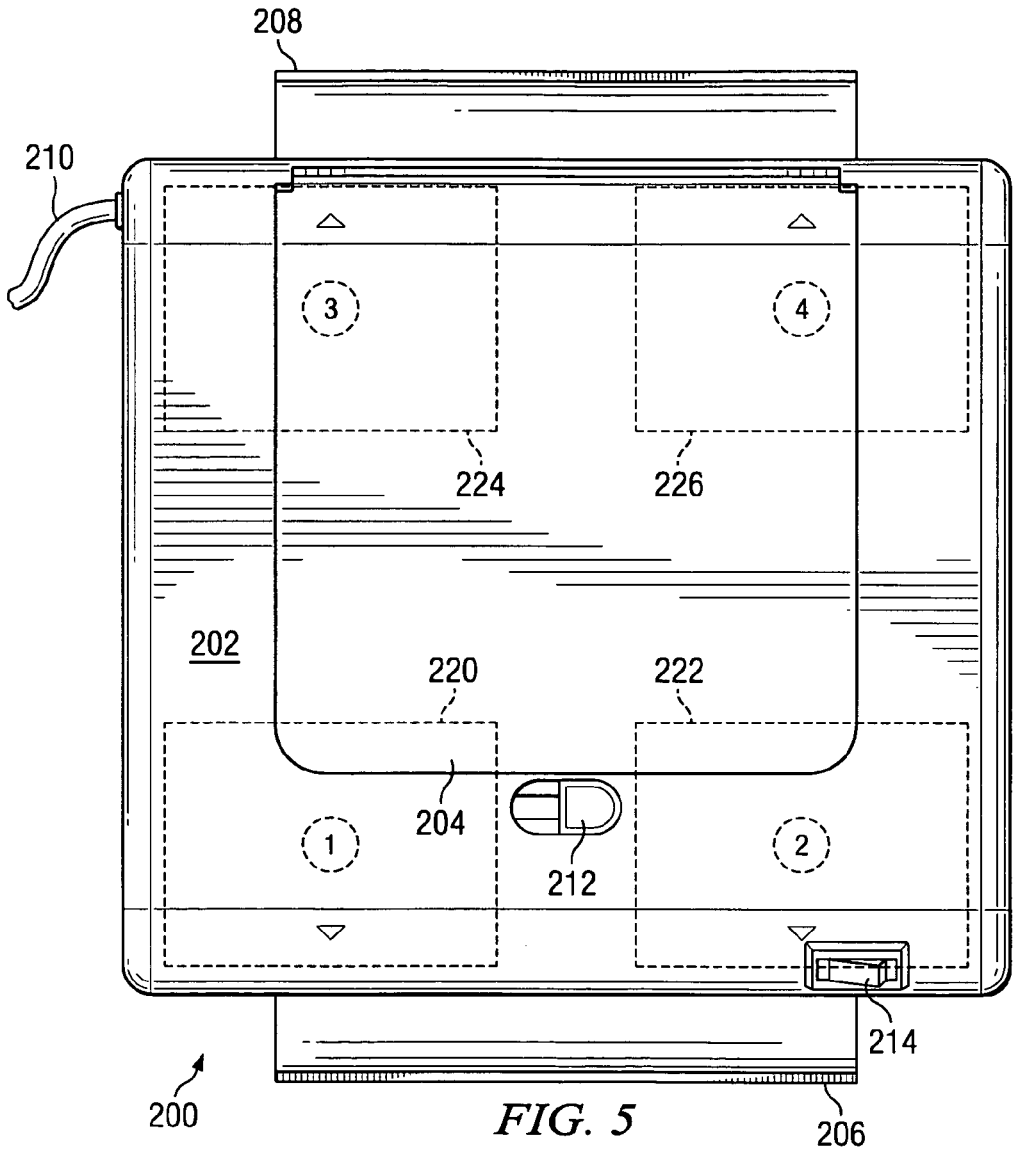
FIG. 5 illustrates a top-down view of the embodiment of FIG. 1 with the lid closed and four functional accessory modules shown in phantom in the positions they could occupy within the apparatus.

Referring to FIG. 5 there is illustrated a downward-looking view of the embodiment of FIG. 1 with a top lid 204 closed and four functional accessory modules, i.e., expansion modules, shown in phantom in the positions 1, 2, 3 and 4 that they could occupy within the apparatus. A connection system 200, which is identical to the connection system 10 shown in FIG. 1, is shown having an enclosure 202, a top lid 204, a front access door 206, a rear access door 208, a power cord 210, a top lid latch 212 and an ON/OFF switch 214. The four modules shown in locations 1, 2, 3 and 4 are the functional accessory modules 220, 222, 224 and 226 respectively. Examples of the individual functional accessory modules will be described further herein below.

Figure 6A:
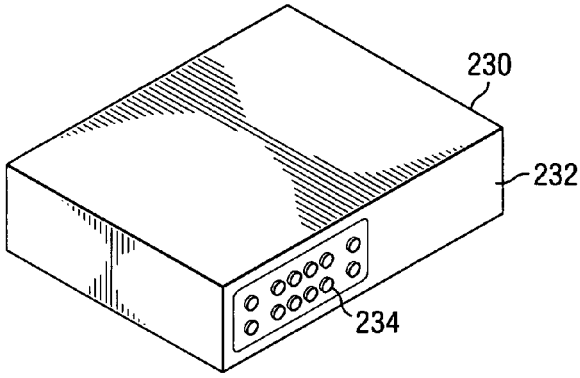
FIG. 6A illustrates a front perspective view of one type of functional accessory module that may be housed within the apparatus of FIG. 1.
Figure 6B:
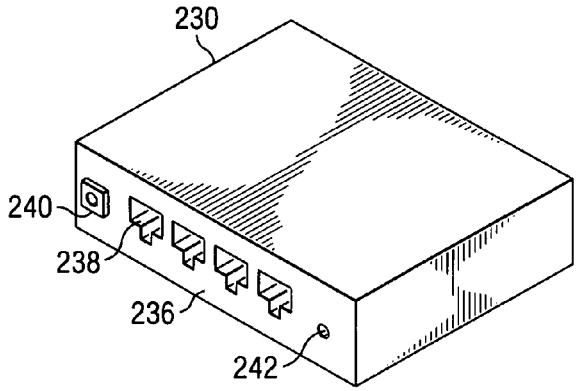
FIG. 6B illustrates a rear perspective view of the functional accessory module illustrated in FIG. 6A.

Referring to FIG. 6A there is illustrated a front perspective view of one type of functional accessory or connectivity module that may be housed within the apparatus of FIG. 1. A connectivity module 230 is shown that includes a front panel 232, on which may be located several status indicators 234. The connectivity module 230 may be, for example, a "Cable/DSL 4-Port Firewall Router" for enabling multiple users to share a broadband connection to the Internet such as the type TW100-BRF114 available from Trendware International, Inc. of Torrance, Calif. A rear perspective view of the firewall router connectivity module 230 illustrated in FIG. 6A is shown in FIG. 6B. The rear panel 236 includes four type RJ45 port connections indicated by the reference number 238, a power connection 240 and an antenna terminal 242. The four RJ45 port connections 238 may 10/100 Mbps Ethernet ports for connection to a LAN having several PCs and workstations, for example. The exemplary connectivity module 230 measures approximately 1"×4"×5.5" and may readily be installed in the enclosure 12 of the connection system 10 shown in FIG. 1.

Figure 7A:
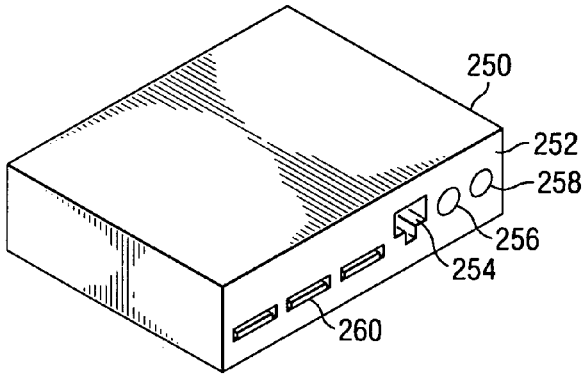
FIG. 7A illustrates a front perspective view of another type of functional accessory module that may be housed within the apparatus of FIG. 1.
Figure 7B:
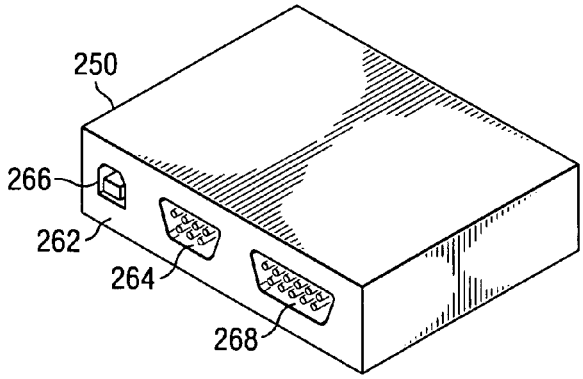
FIG. 7B illustrates a rear perspective view of the functional accessory module illustrated in FIG. 7A.

FIG. 7A illustrates a front perspective view of another type of functional accessory or mobile docking module that may be housed within the apparatus of FIG. 1. A mobile docking module 250 is shown that includes a front panel 252, on which may be located an RJ45 Ethernet port 254, a PS/2 keyboard port 256, a PS/2 mouse port 258, and three USB 2.0 type A ports 260. The mobile docking module 250 may be, for example, a type TU2-ET200 "USB 2.0 Mobile Docking Station" available from Trendware International, Inc., for enabling users to connect up to eight different peripherals to USB enabled computers. The mobile docking module 250 is especially adapted to providing docking facilities for a laptop computer to an intranet/Internet connection and a system of peripherals. A rear perspective view of the mobile docking module 250 illustrated in FIG. 7A is shown in FIG. 7B. The rear panel 262 includes a DB 9-pin RS232 modem connector 264, a USB 2.0 Type B port 266 and a DB 25-pin parallel printer port 268. The mobile docking module 250 may further include a USB-to-Ethernet adapter and a three-port USB hub. The exemplary mobile docking module 250 measures approximately 1"×2.5×4.7" and may readily be installed in the enclosure 12 of the connection system 10 shown in FIG. 1.

Figure 8A:
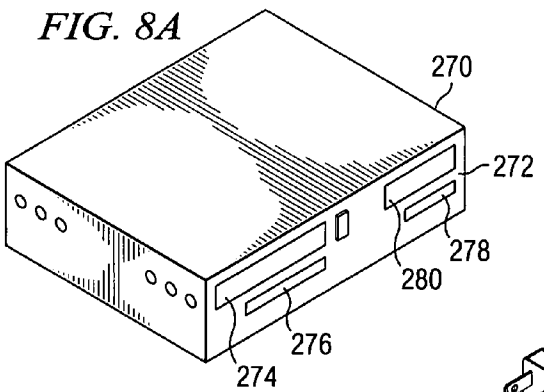
FIG. 8A illustrates a front perspective view of yet another type of functional accessory module that may be housed within the apparatus of FIG. 1.
Figure 8B:
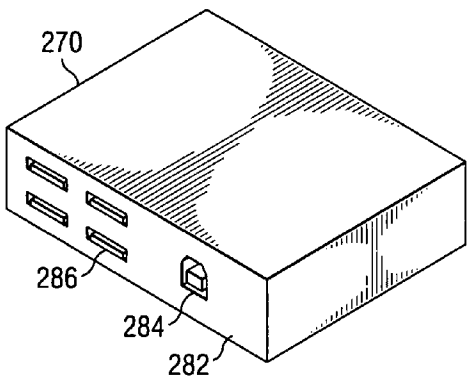
FIG. 8B illustrates a rear perspective view of the functional accessory module illustrated in FIG. 8A.

FIG. 8A illustrates a front perspective view of yet another type of functional accessory or convenience module that may be housed within the apparatus of FIG. 1. A convenience module 270 is shown that includes a front panel 272, on which may be located ports for receiving various types of memory devices including, for example, a compact flash card 274, a smart media card 276, a secure digital card 278 and a memory stick 280. The convenience module 270, which may be a type TMR-61U2 Memory Card Reader/Writer available from Trendware International, Inc., may also, according to the manufacturer, read and write to a micro drive or a multimedia card. This module may further provide data transfer capabilities between a desktop computer and/or among a variety of memory devices. A rear perspective view of the convenience module 270 illustrated in FIG. 8A is shown in FIG. 8B. The rear panel 282 includes a USB 2.0 network connector 284 and may also include a plurality of USB 2.0 ports 286. The exemplary convenience module 270 measures approximately 0.8"×3.3×4.3" and may readily be installed in the enclosure 12 of the connection system 10 shown in FIG. 1.

Figure 9:
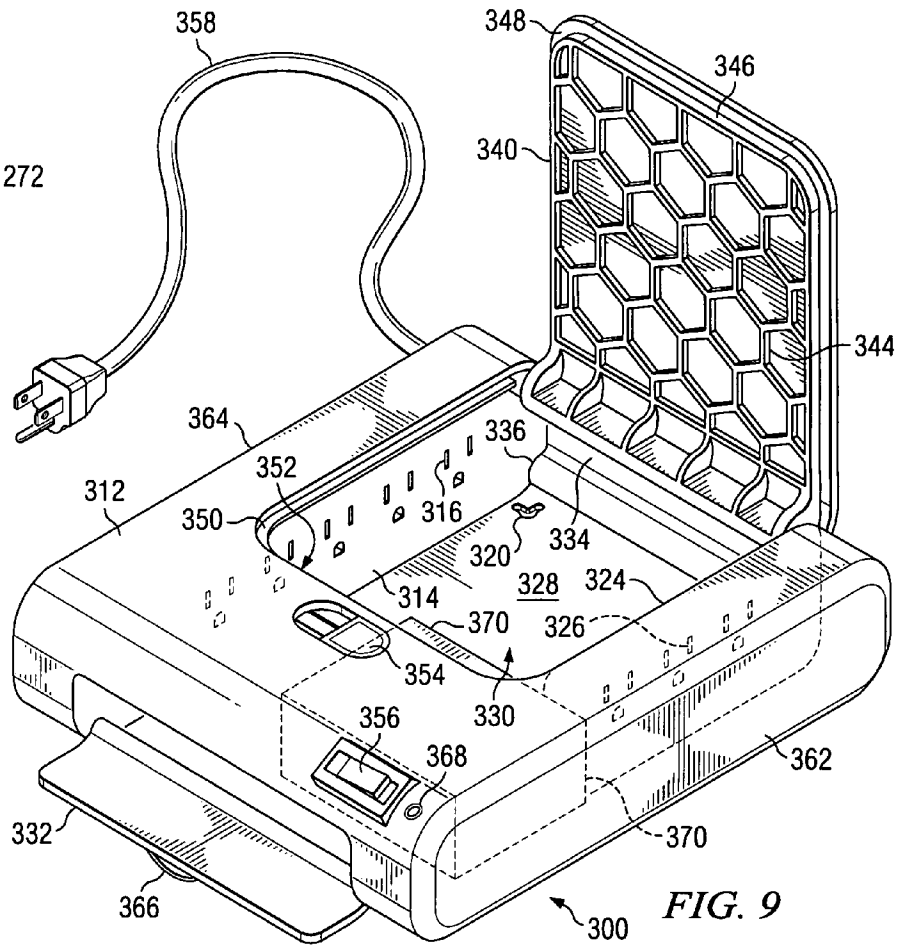
FIG. 9 illustrates a perspective view of an embodiment similar to the embodiment of FIG. 1 but with a functional accessory module housed within the enclosure of the apparatus for connecting and storing cords and cables.

Referring to FIG. 9 there is illustrated a perspective view of an embodiment similar to the embodiment of FIG. 1 but with a functional accessory module 370 a (shown in dashed outline as a rectangular block) housed within the enclosure of the apparatus for connecting and storing cords and cables. The connection system 300 includes a housing or enclosure 312. Visible inside the enclosure 312 is a first interior side panel 314 upon which are mounted a plurality of AC receptacles such as the receptacle 316. Also included inside the enclosure 312, and directly opposite the first interior side panel 314, is a second interior side panel 324 upon which are mounted a plurality of AC receptacles 326 shown in phantom outline. The second interior side panel 324 is shown by a dashed outline surrounding the three AC receptacles 326. Further, the first and second interior side panels 314, 324 generally face each other across a floor 328 of the enclosure 312, and in the illustrative embodiment may be substantially parallel to each other. The floor 328 of the enclosure 312 may include several holes, e.g., at three or four corners of the floor 328, such as the mounting hole 320, for mounting the enclosure 312 on a wall or other vertical surface. The floor 328 of the enclosure may further include, on its underside and thus not visible in FIG. 1, non-skid mounting feet to support the connection system 300 just off the desktop or shelf on which it is located.

It will be appreciated that, unlike many of the prior art devices for connecting power cords, the space 330 between the first and second interior side panels 314, 324 of the present invention, and substantially between interior front and rear portions of the enclosure 312, is unobstructed by other structures. This unobstructed space thus provides the maximum space and flexibility for storing excess lengths of cords and cables or for storing one or more functional accessory modules 370 within the enclosure 312 during use. The functional accessory module 370 shown partially in dashed lines in FIG. 9 may be any of the types described herein above or any other type that is physically and functionally adapted for use within the connection system 300 disclosed herein and in cooperation with an equipment installation as also described herein. The location shown is merely illustrative and may be adapted to any of the locations illustrated in FIG. 4, for example. In the illustrated embodiment, the length of the second interior side panel 324 may be shortened at the front end (proximate the ON/OFF switch 356) to better accommodate the module 370. Accordingly, the second interior side panel 324 will include fewer AC receptacles 326 mounted thereon.

Further with respect to the functional accessory modules that may be appropriately stored within the connection system 300 of FIG. 9, in general, the functional accessory modules may include one or more of the following devices: communication interface adapters, memory expansion adapters, card reading adapters (memory type, typically, but could be any readable device), audio or video adapters, system status adapters, printing or display adapters, and the like. As examples, the communication interface adapters may include without limitation modems, routers and other connectivity modules such as bus expansion adapters and wireless interfaces. Further, the memory expansion adapters may include without limitation smart cards, multimedia cards, flash memory, memory sticks, back-up devices, mass storage devices and interfaces therefor. Moreover, the enclosure 312 may be adapted to accommodate connecting means for terminating or routing signal cables that are associated with one or more of the multiple devices of the equipment installation.

The first and second interior side panels 314, 324, even if shortened to accommodate a functional accessory module 370, may serve several other structural functions in the illustrative embodiment in addition to providing a convenient and solid mounting surface for the AC receptacles 316, 326. The side panels 314, 324 form an enclosed space behind them for isolating live wiring components of the power circuits connected to the AC receptacles. Further, the side panels 314, 326 may serve as structural bulkheads that provide substantial vertical support for the top surface of the enclosure 312, including the top lid 340, when it is in a closed position. In other embodiments having fewer AC receptacles 316, 326, one or both of the side panels 314, 324 may be shorter, not extending fully across the front-to-back length of the enclosure 312, to provide room for expansion or functional accessory modules. In such cases, additional bulkheads or sub-enclosures (not shown) may be included to provide isolation of live circuitry from the interior 330 of the enclosure 312.

Continuing with FIG. 9, the enclosure 312 may include a front access door 332 that pivots along an axis approximately coincident with a lower edge of the access door 332. Similarly, the enclosure 312 may include a rear access door 334 that pivots along an axis of a hinge 336 approximately coincident with a lower edge of the access door 334. Cords and cables to be routed into and connected to receptacles or modules within the enclosure 312 may be passed through either or both of the access doors 332,334. The access doors 332,334 may be configured to pivot outward from the upper edge of the respective access door opening and away from the enclosure 312. The access doors 332, 334 may also be configured with a latching mechanism (not shown) to secure the door to the enclosure 12 when the access doors 332, 334 are in a closed position.

Further, the enclosure 312 includes a top lid 340 that is reinforced by an integral honeycomb structure disposed on the underside surface of the top lid 340. The honeycomb structure 344 extends across both longitudinal and lateral dimensions of the top lid 340, terminating at a perimeter rail 346 formed into the underside of the top lid 340. The honeycomb structure 344 is provided to impart substantial stiffness and load-bearing capability to the top lid 340 when the top lid 340 is in a closed position, particularly when a heavy component, such as a CRT monitor, is stacked on top of the connection system. The top lid 340 may be secured to the enclosure 312 by a latch 354. The latch 354 may be configured to hold the top lid 340 in a closed position despite pressure exerted from below the top lid 340 by cords and cables packed within the space 330 of the enclosure 312.

An ON/OFF switch 356 may be mounted on the enclosure 312, and may include a pilot indicator that illuminates the switch handle when power is ON. A power cord 358, connected internally to power circuits as described (see FIG. 2), is shown exiting the enclosure 312 from a rearward surface thereof and terminated in a standard AC plug. A "surge status" indicator 368 may be provided on the front portion of the enclosure 312 to indicate when the capacity of the surge and transient suppression circuits within the connection system 300 have been compromised as described herein above.

While the invention has been shown in only one of its forms, it is not thus limited but is susceptible to various changes and modifications without departing from the spirit thereof.

What is claimed is:

1. An apparatus for concealing, connecting and organizing power cords and signal cables from multiple devices in an equipment installation, comprising:

an enclosure having a compact configuration for use on a desktop and having first and second interior side panels facing each other without obstruction therebetween across a floor of the enclosure, at least one access opening, and a hinged, reinforced, load-bearing top lid;

a plurality of AC power outlets disposed on both of the first and second interior side panels and connected in a power circuit via an ON/OFF switch to a power supply cord; and electrical circuitry within the enclosure coupled with the power circuit for suppressing interference and transients;

wherein the enclosure includes a storage space between the first and second interior panels for containing and plugging in compact power supply blocks and for connecting, organizing and storing excess lengths of the cords and cables.

2. The apparatus of claim 1, wherein the load-bearing top lid is reinforced by an integral honeycomb structure disposed on an underside surface of the top lid.

3. The apparatus of claim 1, wherein the enclosure further includes non-obstructive securing means for bundling and restraining cords and cables of the equipment installation that are stored therein.

4. The apparatus of claim 3, wherein the non-obstructive securing means includes at least one securing means selected from the group consisting of anchor surfaces on the floor for a fixing adhesive cable retaining devices, openings in the floor for securing cable tying fasteners, and a latching mechanism for securing an edge of the top lid to the enclosure.

5. The apparatus of claim 1, wherein the enclosure accommodates receiving, docking or containing one or more functional accessory modules therewithin that are associated with the multiple devices of the equipment installation.

6. The apparatus of claim 5, wherein the functional accessory modules include one or more devices selected from the group consisting of communication interface adapters, memory expansion adapters, card reading adapters, audio or video source adapters, system status indicators, and printing or display adapters.

7. The apparatus of claim 6, wherein the communication interface adapters include modems, routers, and other connectivity modules such as bus expansion adapters and wireless interfaces.

8. The apparatus of claim 6, wherein the memory expansion adapters include smart cards, multimedia cards, flash memory, memory sticks, back-up devices and mass storage devices and interfaces therefor.

9. The apparatus of claim 1, wherein the enclosure further includes connecting means for terminating or routing signal cables that are associated with the multiple devices of the equipment installation.

10. The apparatus of claim 9, wherein the connecting means includes interfaces to wireless devices.

11. The apparatus of claim 1, wherein the first and second side panels are configured as bulkheads within each left and right side of the enclosure.

12. The apparatus of claim 11, wherein each of the first and second bulkheads extend substantially from a front wall to a rear wall of the enclosure.

13. The apparatus of claim 11, wherein either bulkhead is reduced in length to provide space for a functional accessory module.

14. The apparatus of claim 13, wherein the enclosure is further adapted for receiving, docking or containing one or more functional accessory modules therewithin that are associated with the multiple devices of the equipment installation.

15. The apparatus of claim 14, wherein the functional accessory modules include one or more devices selected from the group consisting of communication interface adapters, memory expansion adapters, card reading adapters, audio or video source adapters, system status indicators, and printing or display adapters.

16. The apparatus of claim 15, wherein the communication interface adapters include modems, routers, and other connectivity modules such as bus expansion adapters and wireless interfaces.

17. The apparatus of claim 15, wherein the memory expansion adapters include smart cards, multimedia cards, flash memory, memory sticks, back-up devices and mass storage devices and interfaces therefor.

18. The apparatus of claim 1, wherein the multiple devices may include components of audio, video, computing, security or maintenance equipment installations.

19. The apparatus of claim 1, wherein the at least one access opening is disposed in the rear portion of the enclosure.

20. The apparatus of claim 1, wherein the at least one access opening is disposed in the rear or the front or both the rear and the front portions of the enclosure.

* * * * *